US005087350A

United States Patent [19]

Paris-Marcano

[11] Patent Number: 5,087,350

[45] Date of Patent: Feb. 11, 1992

[54] PROCESS FOR RECOVERING METALS AND FOR REMOVING SULFUR FROM MATERIALS CONTAINING THEM BY MEANS OF AN OXIDATIVE EXTRACTION

[75] Inventor: Lucinda C. Paris-Marcano, Maracaibo, Venezuela

[73] Assignee: Laboratorios Paris, C.A., Meracaibo, Venezuela

[21] Appl. No.: 630,057

[22] Filed: Dec. 19, 1990

Related U.S. Application Data

[63] Continuation-in-part of Ser. No. 520,549, May 8, 1990.

[51] Int. Cl.[5] ..... C10G 17/02

[52] U.S. Cl. ..... 208/221; 208/219; 208/223; 208/224; 208/225; 208/229; 208/230; 208/252; 208/253

[58] Field of Search ..... 208/190, 203, 219, 221, 208/223, 224, 225, 226, 228, 229, 230, 251 R, 252, 253

[56] References Cited

U.S. PATENT DOCUMENTS

| | | | |
|---|---|---|---|
| 1,997,861 | 4/1935 | Egloff et al. | 208/223 |
| 2,021,739 | 11/1935 | Morrell et al. | 208/223 |
| 2,550,668 | 5/1951 | Brandon et al. | 208/190 |
| 2,863,828 | 11/1958 | Viles | 208/190 |
| 2,915,461 | 11/1959 | Davies et al. | 208/190 |
| 3,095,368 | 6/1963 | Dieber et al. | 208/219 |
| 4,417,986 | 11/1983 | Connaught et al. | 208/226 |
| 4,601,816 | 7/1986 | Rankel | 208/230 |
| 4,786,405 | 11/1988 | Kutty et al. | 208/226 |

*Primary Examiner*—Theodore Morris
*Assistant Examiner*—William C. Diemler
*Attorney, Agent, or Firm*—Fleit, Jacobson, Cohn, Price, Holman & Stern

[57] ABSTRACT

A process for removing S and Fe and to reclaim V, Ni and Co from coal or oil and their derivatives or from minerals. The process is based upon an oxidative extraction performed with hypochlorous acid (HClO) whose oxidizing power is generated and regulated "in situ". The process is particularly applicable to the recovery of V from residual flexi-coke and to the recovery of Ni from coal.

12 Claims, 5 Drawing Sheets

HYPOTHETICAL SCHEME INTERPRETING THE TRANSFORMATION OF NATURALLY OCCURRING CHLOROPHYLL TO PORPHYRINE - LIKE MACROMOLECULES ALONG WITH THE SEQUESTRATION OF VANADIUM.

PORPHYRINE - BEARING SAMPLE

PROCESS FOR RECOVERING METALS AND FOR REMOVING SULFUR FROM MATERIALS CONTAINING THEM BY MEANS OF AN OXIDATIVE EXTRACTION

CROSS-REFERENCE TO RELATED APPLICATIONS

This application is a continuation-in-part of application Ser. No. 07,520,549, filed May 8, 1990.

BACKGROUND OF THE INVENTION

One of the major sources of problems for the oil and coal processing industry and for coal, coke and oil uses is the presence of metals and sulfur. These contaminants poison the catalysts normally utilized during refining processes, mainly for cracking of heavy hydrocarbons present in crude oils. Also the presence of metals and sulfur in fuel oils, coal or coke produces serious environmental pollution following combustion.

Vanadium is preferentially found in crude oil or in coal originated in South America. In the United States the largest concentration of vanadium in the atmosphere occurs where residual fuels of high vanadium content from Venezuela are burned in utility boilers. Also coal ash in the atmosphere, originating from the burning of coke-like materials, contains vanadium.

There are two main reasons to promote the development of metal and sulfur recovery from oil, coal and coke materials. One is the present day concern over the quality of the air, and the second is the necessity to improve new processing methods to face increasing complexity on the chemical composition and structure of the remained deposits.

Also the high level contents of V, Co, or Ni, which often are present in crude oil, coal, coke or their derivatives encourages their recovery from an economic standpoint, especially in view of the actual high prices these metals show in the market.

However, an air pollution-free process for recovering metals from crude oils, coal, coke and related materials, which is also economically feasible with the present day refining methods has not materialized. The problem which has plagued industry is the capital cost associated with the equipment and the method designed to remove such contaminants.

Several methods have been proposed for removing metals (demetallation) and sulfur (desulfurization) from heavy oils and coals. Both metals and sulfur represent an environmental hazard in addition to the difficulties they produce during catalytic processing of crude oil. As an example, the light crude oil deposits in Venezuela are being rapidly depleted and today almost all oil deposits are of heavy and ultra-heavy nature.

The most important metals present in petroleum are nickel and vanadium. V concentration may vary from a small quantity such as 0.01 ppm to large amounts such as 10,000 ppm, and generally is more abundant than Ni, with the exception of crude oil from Africa or Indonesia.

Ni and V are found in crude oil forming two types of metallic compounds: Porphyrin complexes and non-porphyrin complexes. Porphyrin metallic complexes are the most difficult to remove and have been extensively studied because they distill at high boiling point, and also due to their attractive geo-chemistry.

Much research has been done to eliminate metal and sulfur from oil. A number of mineral acids have been used for demetallation purposes. Exxon Company showed that liquid hydrofluoric acid (HF) is an effective demetallizing agent, by extracting V and Ni as an insoluble precipitate. However, HF modifies substantially the chemical structure of the organic matrix in the oil.

Other chemical agents such as chlorine ($Cl_2$), sulfuryl chlorine ($SO_2Cl_2$), nitrogen dioxide ($N_2O_4$), hydroperoxide, and benzoyl peroxide have been also tested. However, direct use of such strong oxidants diminishes the quality of the oil since they modify the chemical structure or composition of organic molecules. Even though $Cl_2$ has proven to be one of the most efficient demetallizating agents, when directly used it produces undesirable addition reactions with some organic molecules. In general, it has been pointed out that oxidants like peracetic acid, sodium hypochlorite and chlorine readily attack the metal-porphyrin complex and extract the metal, but their use has not been successfully accomplished.

Metals are strongly chelated or complexed with organic ligands, preferentially porphyrins (metallo-porphyrins) and heterocyclic molecules containing S, N and O. Their removal is important and constitutes a key factor determining the success or lack of success of a given industrial oil refining operation.

Porphyrins present in petroleum originated in ancient chlorophyll. Through aging, V and Ni exclude Mg from its chlorophyllic frame taking its place. This can be represented by the FIG. 1, adapted from T. F. Yen. ("Trace Substances in Environmental Health", Vol. IV, D. D. Hemphil, Ed., Columbia University of Missouri Press, 1973). It is shown how the chlorophyll is gradually transformed to deoxofiloeritrine an active molecule for chelating V forming a DPED compound which contains chelated V.

At its turn DPED reaches an equilibria with a number of V containing porphyrins as it is partially shown in FIG. 1.

Experts say that coal is a major source of energy and will continue to be so for many years. However, coal contains sulfur, nitrogen and others impurities such as mercury, beryllium and arsenic. These constitute a health hazard and, therefore, coal must be cleaned either before, during, or after combustion to prevent deterioration of environment.

One of the major contaminants which has received deep attention is sulfur. Many desulfurization processes have been developed. Sulfur is present in coal in amounts ranging from traces to 10% as sulfate, pyritic and organic sulfur. The U.S. governmental regulations of atmospheric emission of sulfur oxides from coal combustion have focused on sulfur content reduction.

Physical cleaning and chemical cleaning is currently practiced throughout the coal industry. Chemical cleaning processes which remove a major portion of the sulfur are in the early stages of development and are not yet practiced commercially due to costs.

However, since the world must turn to coal as its major source of energy (the reserves of gas and petroleum are dwindling and expected to be depleted within the next 40–60 years) new, efficient and non-polluting methods need to be developed. Physical separation of sulfur is inadequate; only a portion of the pyritic sulfur and none of the organic sulfur can be removed without high coal losses. On the contrary, chemical cleaning methods available so far can achieve essentially complete removal of the sulfate and pyritic sulfur and up to 50% of the organic sulfur.

Several processes at present can achieve that degree of cleaning. Among them it can be mentioned: ferric-salt leaching, nitrogen dioxide oxidative cleaning, oxidative desulfurization, hydrogen peroxide-sulfuric acid leaching, hydrodesulfurization, etc. Most of these and other chemical cleaning processes are still in the early stages of development.

The method herein disclosed to recover metals and to eliminate sulfur is based on the oxidating effect of hypochlorous acid which is released in situ upon combining a hypochlorite salt solution with a mineral strong acid. The chemical reactions operating between this acid mixture and the metals and sulfur present in the material produce a high demetallation and desulfurization yield, but without affecting the structure of the organic matrix in the case of oil materials. The method can be conveniently adapted to the cleaning of coal, especially to those which possess valuable metals susceptible to being recovered.

SUMMARY OF THE INVENTION

The process of the present invention makes possible metal recovery, mainly vanadium, nickel and cobalt and sulfur elimination, from heavy oils, oil fuel, coal, coke and their derivatives after burning or processing, without altering essentially the chemical structure and properties of organic components. Furthermore, the equipment and reagents especially needed to recover vanadium in accordance with the present invention are relatively inexpensive, when compared with conventional ones.

In accordance with the preferred embodiments disclosed in the present invention, sodium hypochlorite and nitric acid solutions are mixed together with the material and the mixture is stirred at room temperature for c.a. 0.3 hours. As a result, the metals and sulfur separate from the material as water soluble compounds and can be easily separated by conventional processes, i.e., filtration or centrifugation. The resulting coal, coke or oil component is essentially free from contaminants and can be further subjected to conventional industrial processes or clean burned.

In another embodiment of the present invention, an alkaline solution is mixed with the material to be treated and then gaseous chlorine is bubbled into the resultant suspension to the point of saturation of the alkaline solution. Bubbling of the gaseous chlorine is stopped and then a strong mineral acid is added to the saturated alkaline solution and the mixture is stirred. As a result, the metals and sulfur separate from the material being treated as water soluble compounds which can be easily separated by conventional processes such as filtration and centrifugation. In this embodiment, the preferred alkaline solution is sodium hydroxide and the preferred mineral acid is nitric acid.

Accordingly, it is an object of the invention to provide a process for the recovery of metals and sulfur from oil, coal or coke or from their derived materials using the oxidizing power of hypochlorous acid, and which does not present a serious air pollution problem and neither modify the chemical structure or physicochemical properties of said oil, coal or coke.

Another object of the present invention is to provide a process for the simultaneous recovery of the valuable metals together with the elimination of sulfur from coal or coke.

Another object of the present invention is to provide a process for the recovery of vanadium and nickel from oil, coal or coke or from their derived materials employing chemical reagents which are comparatively inexpensive.

A further object of the present invention is to provide a process to drastically reduce the porphyrin content of crude oils before their refination.

A still further object of the present invention is to provide a method to recover V, Ni, or Co from their corresponding ores or concentrates.

DETAILED DESCRIPTION OF THE INVENTION

Figure 1:
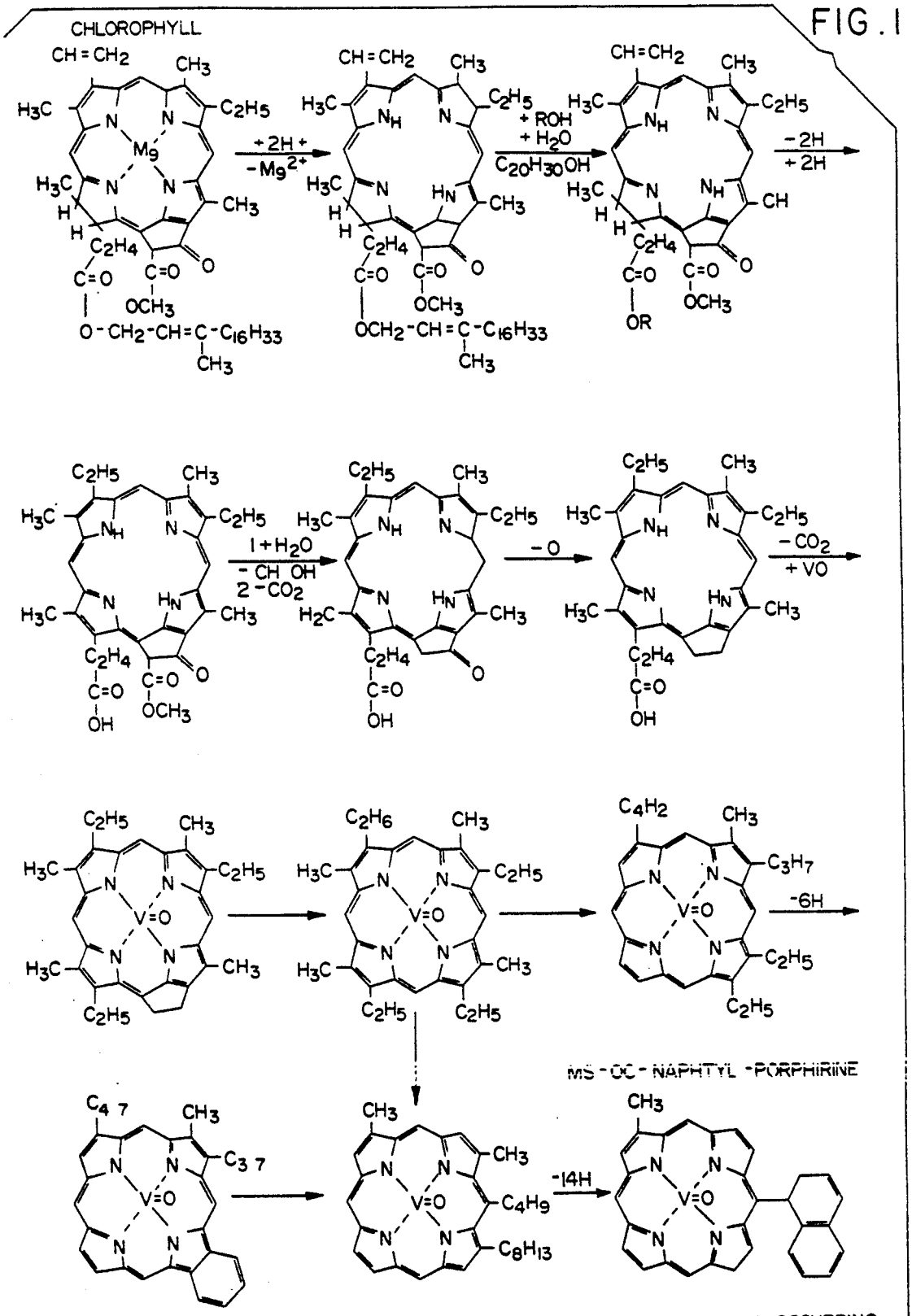
FIG. 1 schematically illustrates the aging and transformation of chlorophyll.

The present invention is based on the finding that, under suitable and very definite conditions, hypochlorous acid (HClO) is able to extract and recover, from a number of different materials substantial amounts of metals and sulfur. The method can readily be applied to a broad number of materials preferentially flexi-coke (a final carbonaceous residue obtained after oil refining), boiler residue scraps from thermo-electrical plants, heavy oil, fuel oil, coal, coke and minerals.

The preferred form of the present invention is a choice of conditions which will maximize the ability of HClO to extract metals and sulfur, but where the economics favor oil cleaning or porphyrin cleavage, it is a great advantage of the present invention that it is equally useful under these conditions. Where the materials treated are solid coal or inorganics containing valuable metals the concentration of the active HClO can be made the highest to obtain a high metal removing yield. On the other hand where the material treated is of an oil-type nature, caution has to be observed on the HClO concentration and the kind of mineral acid since they can produce undesirable side-reactions such as addition and or polymerization reactions; also in these cases the preferred mineral acid is nitric acid, because other acids produce thickening of the oil.

In accordance with the preferred embodiments of the present invention, the material to be treated is mixed with an hypochlorite salt solution, preferably sodium hypochlorite (NaOCl), and with a mineral acid, preferably nitric acid for oil materials and sulfuric acid for coal or inorganic solids. Upon mixing the acid with the hypochlorite, HClO is released gradually "in situ" according to the equation:

$$H^+ + NaClO \rightarrow HClO + Na$$

HClO aqueous acid solution contain small equilibrium amounts of chloride monoxide ($Cl_2O$):

$$2HClO_{(aq)} \rightarrow Cl_2O_{(aq)} + H_2O$$

Hypochlorous acid is a weak acid with a dissociation constant of $2.0 \times 10^{-8}$ at 25° C., but is highly reactive. It is the most stable and strongest of the hypohalous acids and is one of the most powerful oxidants among the chlorine oxiacids. This explains why HClO is able to extract almost quantitatively the metals and sulfur from such stable organic structures as porphyrins in crude oil, or from such chemically inert compounds as boiler residue scraps.

In one embodiment of the present invention, the hypochlorite salt solution is also formed in situ in the reaction vessel in the presence of the material to be treated, by mixing an alkaline solution with the material to be treated in the reaction vessel, and then bubbling gaseous chlorine into the resulting suspension to the saturation point. The saturation point is easily detected by the evolution of free chlorine from the reaction vessel. After the hypochlorite salt solution has thus been formed, the bubbling of the chlorine gas is stopped and a strong mineral acid is added, thereby gradually releasing HClO in situ as described above. Examples of suitable alkaline solutions useful in this embodiment include: sodium hydroxide, calcium hydroxide, potassium hydroxide, calcium oxide, calcium carbonate, magnesium oxide, magnesium carbonate and mixtures thereof. Of these, sodium hydroxide is especially preferred. The stepwise reaction between the chlorine gas and hydroxyl ion provided by the alkaline solution is set forth hereinafter. Examples of suitable mineral acids include: nitric acid, sulfuric acid, hydrochloric acid, phosphoric acid, and mixtures thereof.

A process for removing vanadiu, nickel, cobalt, iron and sulfur from a material, in accordance with this embodiment of the invention, comprises the steps of: (a) mixing the material with an alkaline solution to produce a suspension; (b) bubbling chlorine gas into the suspension produced in step (a) to the saturation point; (c) adding a mineral acid to the saturated suspension produced in step (b); (d) stirring the suspension produced in step (c) at a temperature ranging from about 20° to 100° C.; then (e) separating an aqueous phase of the stirred suspension from residual material in the stirred suspension. The separated aqueous phase contains substantially all of the vanadium, nickel, cobalt, iron and sulfur originally present in the treated material.

This process of the present invention may further include the steps of: (f) adjusting the pH of the aqueous phase of step (e) to pH 7 to higher by adding a basic material, thereby forming a first precipitate in the aqueous phase; (g) separating the first precipitate from the aqueous phase, this first precipitate containing substantially all of the iron, nickel and cobalt originally present in the treated material; (h) adjusting the pH of the aqueous solution from steps (f) and (g) to pH 6 or less by adding a mineral acid thereby forming a second precipitate in the aqueous phase; and then (i) separating the second precipitate formed at step (h) from the aqueous phase, this second precipitate consisting essentially of vanadium pentoxide whereby substantially all of the vanadium originally contained in the treated material is recovered, and whereby substantially all of the sulfur originally contained in the material is present as a soluble salt in the aqueous phase.

Suitable mineral acids for use in step (c) and in step (h) of these processes include: nitric acid, sulfuric acid, hydrochloric acid, phosphoric acid and mixtures thereof. Preferably, the mineral acid is an aqueous solution in which the concentration of the acid is between 0.02 to 36N.

Suitable basic materials for use in step (f) include: oxides, hydroxides, carbonates, and bi-carbonats of alkaline metals, earth-alkaline metals and ammonium and mixtures thereof. Preferably, this basic material is an aqueous solution in which the concentration of the base is between 0.02 to 14N.

A process, also in accordance with this embodiment, for reducing the porphyrin, sulfur and/or metal content of crude oil before refining, without modifying substantially the chemical structure and physico-chemical properties of other organic compounds present in the crude oil, includes the steps of: (a) mixing the crude oil with an alkaline solution to produce a suspension; (b) bubbling chlorine gas into the suspension produced in step (a) to the saturationpoint; (c) adding a mineral acid to the saturated suspension produced in step (b); (d) adding a light organic solvent to the resulting mixture from step (c); (e) stirring the mixture from step (d) at a temperature ranging from about 20° to 70° C.; and then (f) separating an aqueous phase of the stirred mixture from an oil phase of the stirred mixture, this oil phase containing crude oil or reduced porphyrin, sulfur and/or metal content. Suitable light organic solvents useful in this process include: kerosene, gasoline, xylol, toluene, chloroform, carbon tetrachloride and tetrahydrofuran.

This process of the present invention may further include the steps of: (g) adjusting the pH of the aqueous phase of step (f) to pH 7 or higher by adding a basic material, thereby forming a first precipitate in the aqueous phase; (h) separating the first precipitate from the aqueous phase, this first precipitate containing substantially all of the iron, nickel and cobalt originally present in the material; (i) adjusting the pH of the aqueous solution from steps (g) and (h) to pH 6 or less by adding a mineral acid thereby forming a second precipitate in the aqueous phase; and (j) separating the second precipitate formed at step (i) from the aqueous phase, this second precipitate consisting essentially of vanadium pentoxide whereby substantially all of the vanadium originally contained in the material is recovered, and whereby substantially all of the sulfur originally contained in the material is present as a soluble salt in the aqueous phase.

In order to assure metal and sulfur recovery not significantly below 20% and preferably greater than 60%, the concentration of HClO released "in situ" and the time of extraction reaction must be maintained within certain limits. No accurate figures for HClO concentration can be given, because it is dependent on the acid concentration reacting with the hypochlorite, on the hypochlorite concentration itself, on the temperature, on the particle size of the solid, on the agitation and also on the nature of the material with respect to its reactivity. Where it is desired to extract substantially all the metals and sulfur contained in the material without special care on the structure of the resulting residue, there is no critical upper limit on time and on HClO concentration and they become merely a practical operating condition. Thus for extracting valuable V and Ni from residue scraps high concentration of HClO, which corresponds to high concentration of mineral acid and hypochlorite, should be used. On the contrary, where it is desired to eliminate as much as possible metals and sulfur from heavy oils, but without modifying noticeably the chemical structure to facilitate oil subsequent refining, mild hypochlorite and mineral acid concentration must be employed.

In general for coal, coke, residue scrap or minerals, high concentration such as 15% active $Cl_2$-containing NaClO and concentrated acid both in a ratio of 2:1 can be conveniently used. For oil, low NaOCl concentrate such as 5% active $Cl_2$-containing NaClO is desirable combined in a ratio of 9:1 with nitric acid.

Off gases from the reactor are composed essentially by chlorine as the main by-product in the oxidation reaction promoted by HClO. Metals and sulfur reach their highest oxidation states forming soluble compounds. Chlorine can be easily recovered by bubbling it into a base solution and also by reacting with solid basic materials as calcium chloride; sodium hydroxide is the preferred strong base employed and when $Cl_2$ bubbles the reaction occurs stepwise:

$$Cl_2 + 2OH^- \longrightarrow ClO^- + Cl^- + H_2O \xrightarrow{Cl_2} 2HClO + 2Cl^-$$

the resulting ClO and HClO solution can be easily recycled into the system.

Metals in the soluble forms after separating from the residual material can be recovered readily by increasing the pH. By adding a strong base like NaOH, Ni, Co and Fe are removed together as insoluble hydroxides; however, if ammonium hydroxide is used only Fe(III) is precipitated while Co and Ni remain in solution as the corresponding ammoniacal complexes. Once the iron (III) hydroxide is separated nickel and cobalt complexes can be destroyed by acidifying and heating and then precipitated as the corresponding hydroxides by adding a strong base.

Vanadium is kept soluble throughout all the chemical treatment after the extraction with HClO, and it ends up in the final solution (after Fe, Ni, Co separation) as vanadate. From this final solution V can be readily reclaimed by acidifying with a strong acid, preferentially nitric acid. An orange red vanadium pentoxide, essentially free of other metal contaminants, precipitates and is recovered by filtration.

Sulfur is oxidized to +6 oxidation state and removed as soluble sulfate into the final solution obtained after filtering the vanadium pentoxide. Its recovery can be achieved by simple precipitation with a calcium salt or crystallized as sodium or potassium salt after neutralization with an appropriate base.

The process of the present invention is further illustrated by the following non-limiting examples.

EXAMPLE 1

100 g. of flexi-coke from a Venezuelan oil refinery is loaded in a sealed one liter flask provided with two glass pipe line. The flexi-coke has the average composition as set forth in Table 1 below. 100 ml of a 10% sodium hypochlorite solution and 10 ml of concentrated nitric acid solution are fed through one line. The reagents mix together producing in situ hypochlorous acid in an excess of $HNO_3$.

The mixture is stirred 5 minutes by means of a magnetic stirring bar. During this step chlorine gas evolves and is collected through the other, shorter glass line in an open erlenmeyer flask containing 3% NaOH solution. After collecting the gas, sodium hypochlorite is regenerated according to the known reaction:

$$2NaOH + Cl_2 \rightarrow NaOCl + NaCl + H_2O$$

The resulting suspension in the flask is filtered through an ordinary filter paper and the yellow filtrate is collected. The residual flexi-coke is washed twice with 30 ml portion of tap water. The chemical composition of the resulting residue after treatment is also shown in Table 1. The first filtrate and the washing solution are mixed together to form Solution 1.

Solution 1 having a pH of about 3.0 is neutralized and alkalinized with a 10% NaOH solution to obtain a mixed solid precipitate containing essentially all the Ni, Co, and Fe extracted from the flexi-coke. This precipitate is filtered, washed and preserved for further Ni or Co recovery.

The second filtrate, Solution 2, contains essentially all the vanadium extracted from the flexi-coke, in the form of sodium vanadate.

Solution 2 is heated to boiling and then acidified by adding carefully nitric acid up to pH 1-2. Red vanadium pentoxide ($V_2O_5$) precipitates. This precipitate is washed and collected for further purification process or for metallic vanadium obtainment following known technology. Within the methods available it can be mentioned iodide refining, electrolytic refining in a fused salt, and electrotransport.

TABLE 1

| COMPOSITION OF FLEXI-COKE | V (%) | Ni (%) | Co (%) | Fe (%) |
|---|---|---|---|---|
| Before Treatment | 8.82 | 2.45 | 0.45 | 3.75 |
| After Treatment | 0.10 | 0.01 | 0.001 | 0.01 |

EXAMPLE 2

Example 1 was repeated, but using 100 g. of boiler residue scrap from a thermo-electrical plant, instead of flexi-coke. The result obtained is shown in Table 2 below.

TABLE 2

| COMPOSITION OF BOILER RESIDUE SCRAP | V (%) | Ni (%) | Co (%) | Fe (%) |
|---|---|---|---|---|
| Before Treatment | 15.0 | 5.3 | 0.95 | 3.2 |
| After Treatment | 0.1 | 0.01 | 0.001 | 0.02 |

EXAMPLE 3

100 ml of a Venezuelan crude oil is placed in a flask similar to that of Example 1, then 50 ml of kerosene or any other economically convenient solvent which does not fracture the oil is added to diminish viscosity and improve stirring. 20 ml of HClO solution freshly prepared by mixing 65 ml of a 5% NaOCl solution and 5 ml of concentrated nitric acid is added. After 5 minutes stirring, both liquid phases, aqueous and organic ones, are separated each other by means of a decantation funnel. The process continues subjecting the aqueous phase to the procedure as described in Example 1. The results obtained are shown in Table 3 below.

TABLE 3

| CRUDE OIL COMPOSITION | V (ppm) | Ni (ppm) | Fe (ppm) | S (%) |
|---|---|---|---|---|
| Before Treatment | 1900 | 455 | 355 | 1.70 |
| After Treatment | 19 | 4.5 | 5.5 | 0.05 |

EXAMPLE 4

Example 3 was repeated, but utilizing 100 ml of residual fuel oil instead of crude oil. The results obtained are the following:

TABLE 4

| RESIDUAL OIL COMPOSITION | V (ppm) | S (%) |
|---|---|---|
| Before Treatment | 457 | 2.29 |
| After Treatment | 5 | 0.17 |

EXAMPLE 5

Figure 2:
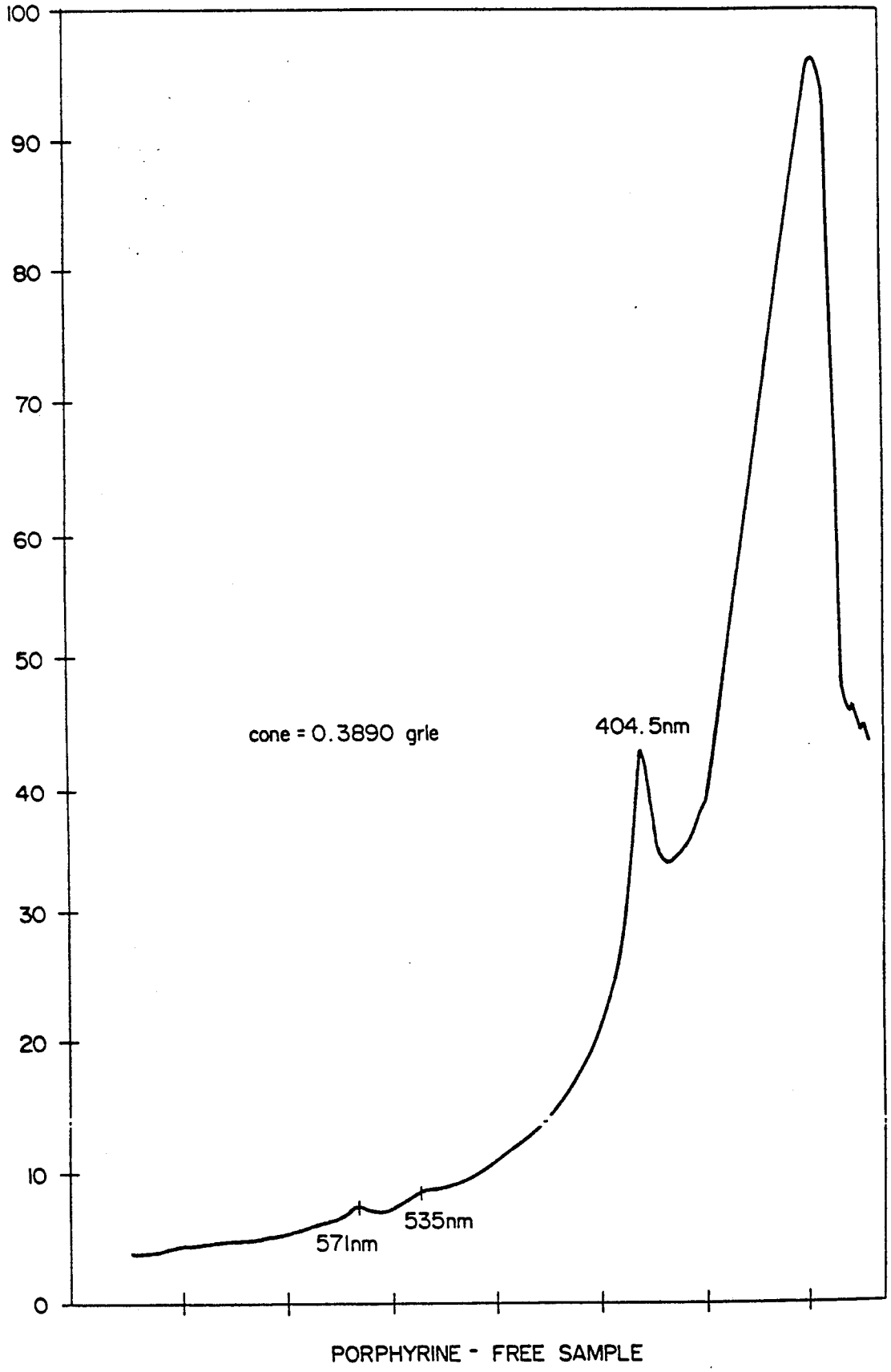
FIGS. 2 and 3 show absorption spectra for an oil sample before and after, respectively, treatment in accordance with the present invention.
Figure 3:
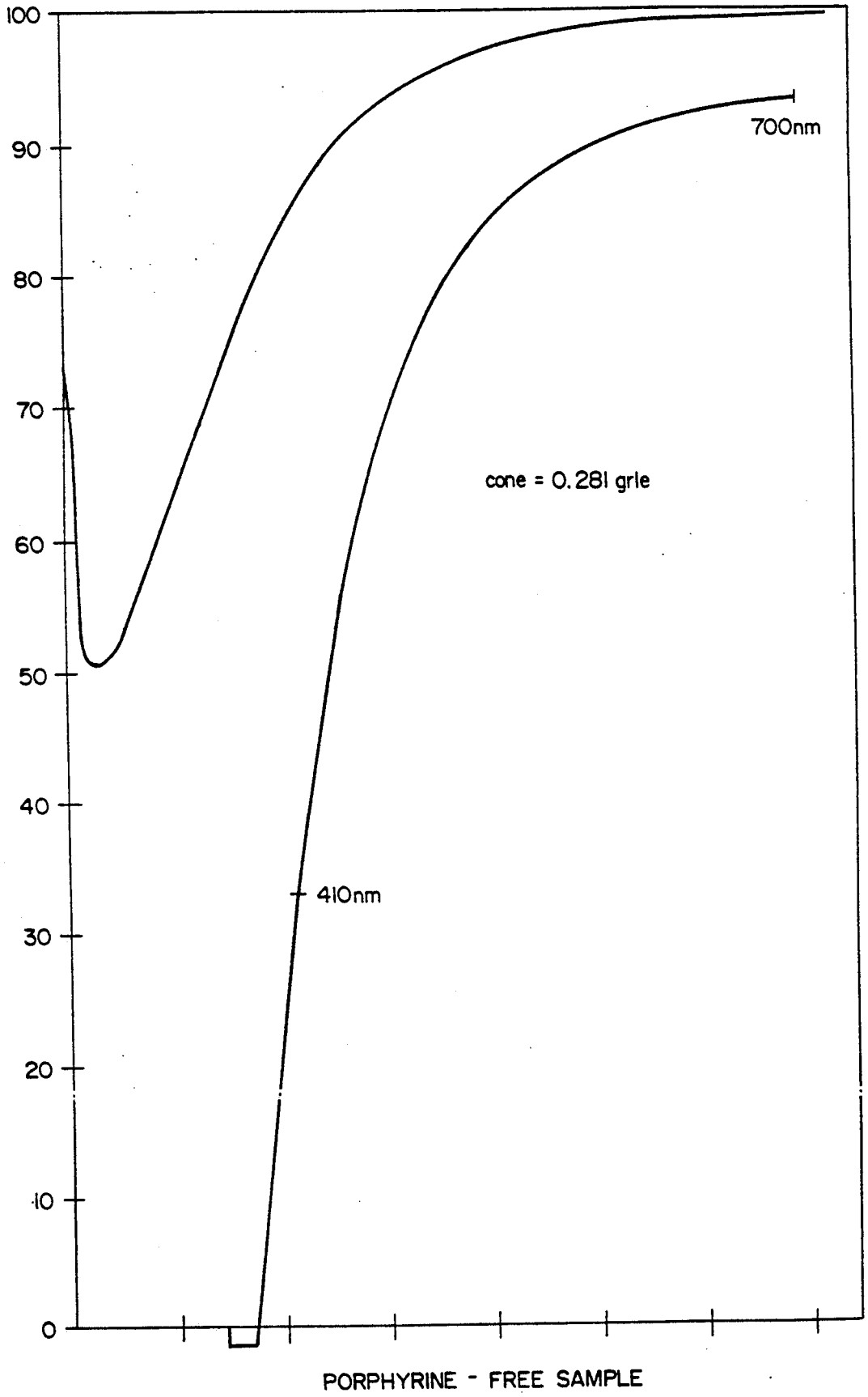
Figure 4:
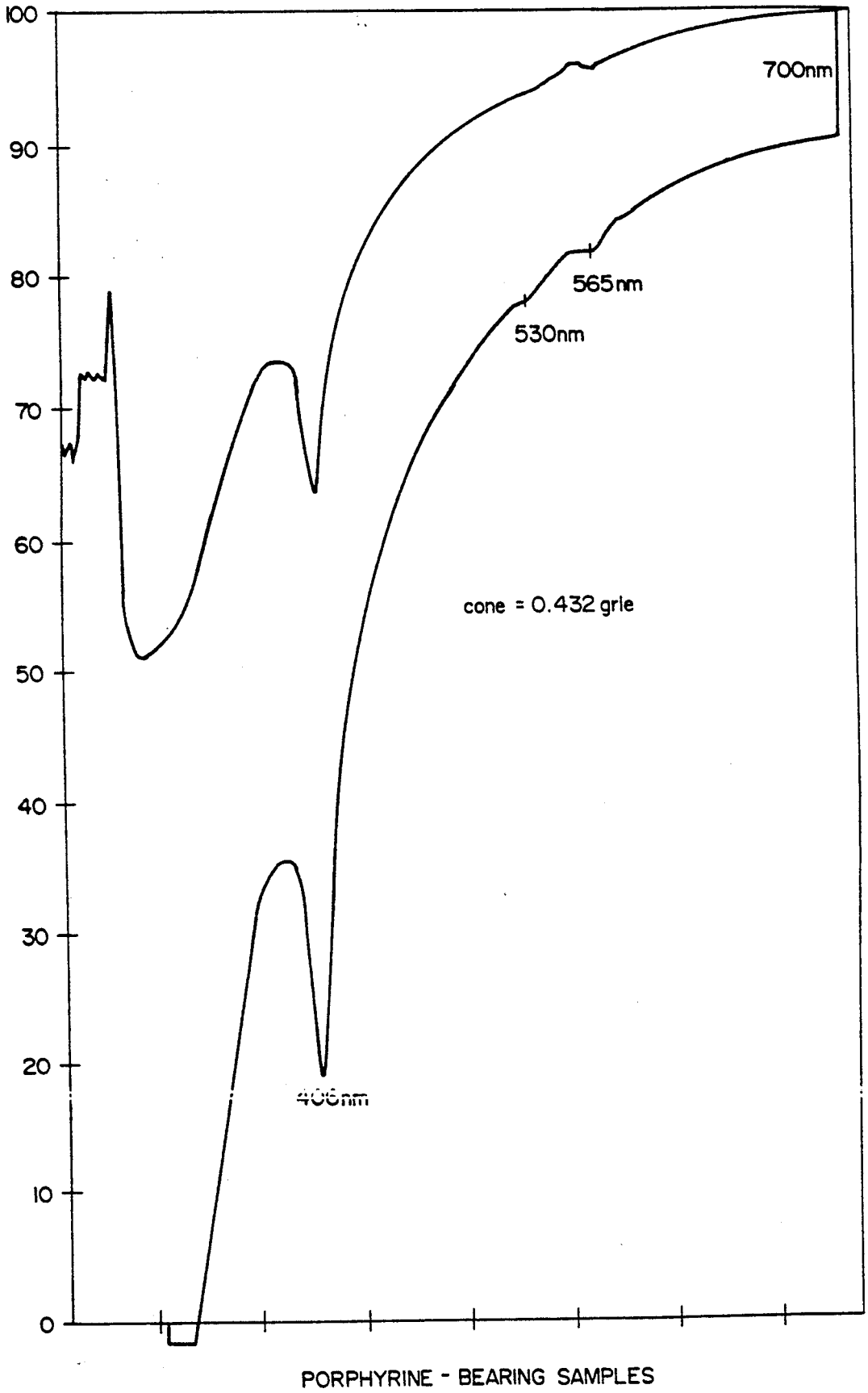
FIGS. 4 and 5 show absorption spectra for another sample before and after, respectively, treatment in accordance with the present invention.
Figure 5:
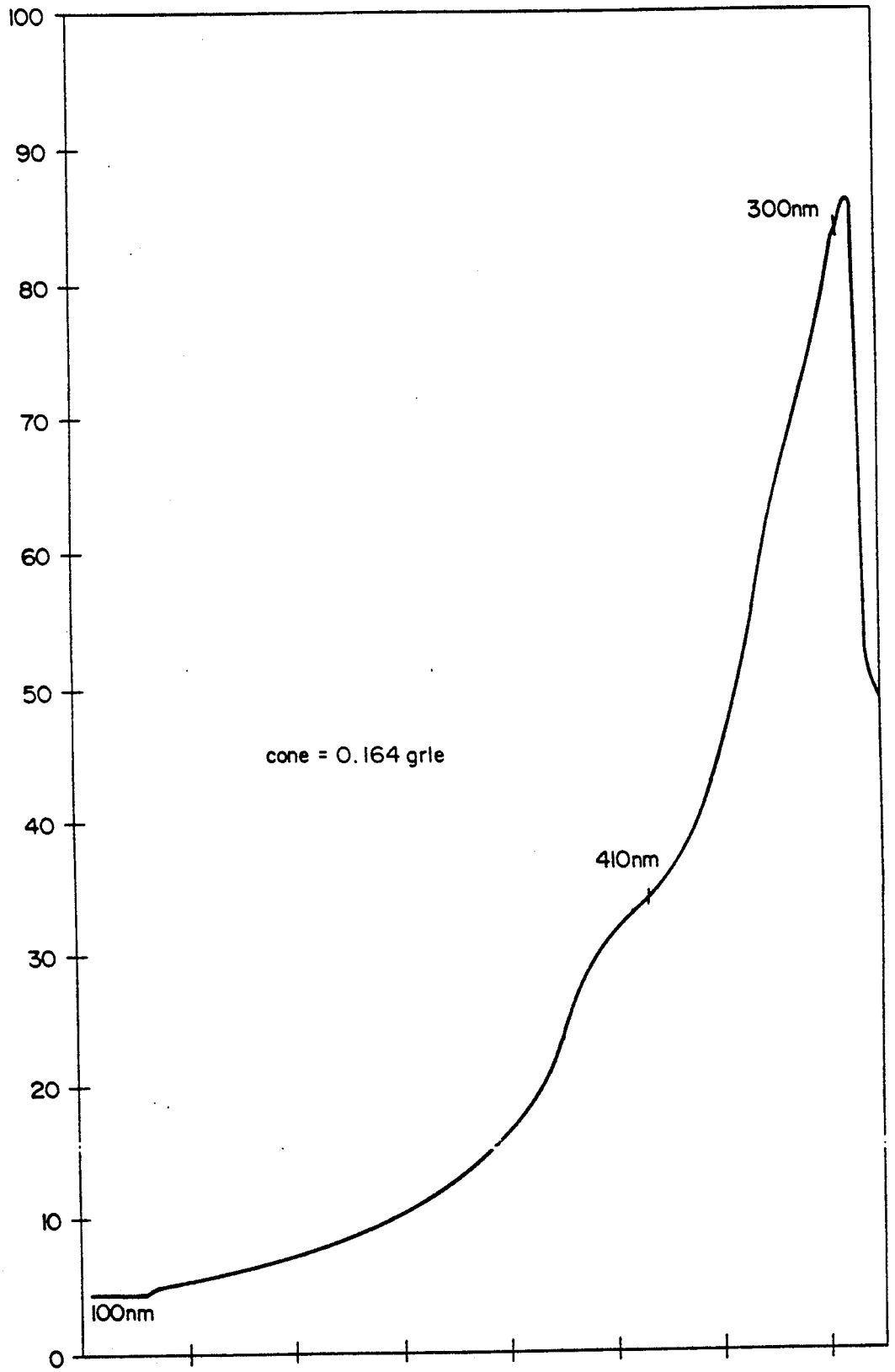

Oil samples of Examples 3 and 4 before and after treatment were subjected to spectrophotometric analysis. The absorption spectra depicted in FIGS. 2, 3, 4 and 5 show that the normal porphyrin band absorption at 410 nm, characteristic of heavy crude oil, disappears after subjecting the oil samples to the method of the present invention.

EXAMPLE 6

100 g. of coal are subjected to the same process as explained in Examples 1 and 2. The results obtained are:

TABLE 5

| COMPOSITION OF COAL | Ni (%) | S (%) |
|---|---|---|
| Before Treatment | 3.73 | 2.75 |
| After Treatment | 0.15 | 0.25 |

These results show that Ni recovery from the coal can support economically the cleaning process or desulfuration of that coke.

EXAMPLE 7

Several samples Co-ores (Cobaltite), V-ores (Vanadite) and Ni-containing ores were processed according to the method of the present invention and detailed in Examples 1 and 2. Chemical analysis by atomic absorption spectrometry show that nearly 90% of the corresponding metal present in the ore is recovered.

EXAMPLE 8

100 g. of cobaltite containing 0.7% w/w of Co was placed in a 4 cm width-30 height glass column and made moist with a 3% NaOCl solution. Then a 10% $H_2SO_4$ solution was forced to move the column by using the principle of communicating vessels. As the sulfuric acid moves upward through the column and contacts the hypochlorite solution absorbed onto the cobaltite ore, HClO is gradually formed, attacking the mineral and dissolving the metals, preferentially those present as sulfide such as cobalt. Also, chlorine gas evolves gradually and is collected as it flows out the open top of the column. Five 200 ml portions of 10% $H_2SO_4$ solution were upward percolated through the column and cobalt recovery was determined by atomic absorption spectrometry. Results obtained showed that 90.6% of the total Co, present in the 100 g. portion of the cobaltite, was recovered in the sulfuric solutions.

EXAMPLE 9

Example 8 was repeated but using 100 g. of flexi-coke (the same as in Example 1) instead of cobaltite. Results demonstrated that 95% of vanadium, 85% of Ni and 92% of the Co contained in the material were reclaimed in the sulfuric acid.

EXAMPLE 10

Example 8 was repeated but using 100 g. of boiler residue scrap (the same as in Example 3) instead of cobaltite. Analysis of upward percolated $H_2SO_4$ showed that 91% V, 80% Ni, 87% Co and 72% Fe originally contained in the scrap were recovered.

EXAMPLE 11

100 grams of flexi-coke is loaded in a sealed one liter flask provided with two glass pipe lines, as in Example 1. 100 ml of 10% sodium hydroxide solution are fed through a first glass pipe line. Then gaseous chlorine is bubbled into the suspension through the same gas pipe line until saturation of the sodium hydroxide suspension is reached. The saturation point is easily detected by the evolution of free chlorine from the reaction flask through the second, shorter glass pipe line. Bubbling of the gaseous chlorine is stopped and then 100 ml of concentrated nitric acid are fed through the first glass pipe line and the mixture is stirred for 5 minutes by means of a magnetic stirring bar. The resulting suspension in the flask is then subjected to the same experimental procedures as the suspension in Example 1. Results similar to that of Example 1 are obtained.

In view of the foregoing teachings of the present invention, it is possible remove sulfur and metals from materials which contain them, especially from petroleum, oil and coal and their derivatives without causing appreciable air pollution.

This is made possible by using inexpensive and common reagents which behave as excellent demetallizing and desulfurization agents, when combined according to the process here described, without altering appreciably the chemical structure of the organic matrix in the case of petroleum, crude oil, or their derivatives. Variations in the parameters disclosed, however, are well within the skill of those in the art in view of the simple but very operative teachings of the present invention.

Thus, the invention may be embodied in other specific forms without departing from the spirit or essential characteristics thereof. The present embodiments are therefore to be considered in all respects as illustrative and non-restrictive, the scope of the invention being indicated by the appended claims rather than by the foregoing descriptions, and all changes which come within the meaning of the claims are therefore intended to be embraced therein.

I claim:

1. A process for removing vanadium, nickel, cobalt, iron and sulfur from an ore, oil, coal or coke material, comprising the steps of:

(a) mixing said material with an alkaline solution to produce a suspension;

(b) bubbling chlorine gas into the suspension produced in step (a) to the saturation point;

(c) adding a mineral acid to the saturated suspension produced in step (b);

(d) stirring the suspension produced in step (c) at a temperature ranging from about 20° to 100° C.; and then (e) separating an aqueous phase of the stirred suspension from residual said material in the stirred suspension, said aqueous phase containing substantially all of the vanadium, nickel, cobalt, iron and sulfur originally present in said material.

2. A process for recovering vanadium, nickel, cobalt and iron and removing sulfur from an ore, oil, coal or coke material, comprising the steps of:

(a) mixing said material with an alkaline solution to produce a suspension;

(b) bubbling chlorine gas into the suspension produced in step (a) to the saturation point;

(c) adding a mineral acid to the saturated suspension produced in step (b);

(d) stirring the suspension produced in step (c) at a temperature ranging from about 20° to 100° C.; and then (e) separating an aqueous phase of the stirred suspension from residual said material in the stirred suspension;

(f) adjusting the pH of the aqueous phase of step (e) to pH 7 or higher by adding a basic material, thereby forming a first precipitate in the aqueous phase;

(g) separating said first precipitate from the aqueous phase, said first precipitate containing substantially all of the iron, nickel and cobalt originally present in said material;

(h) adjusting the pH of the aqueous solution from steps (f) and (g) to pH 6 or less by adding a mineral acid thereby forming a second precipitate in the aqueous phase; and (i) separating the second precipitate formed at step (h) from the aqueous phase, said second precipitate consisting essentially of vanadium pentoxide whereby substantially all of the vanadium originally contained in the material is recovered, and whereby substantially all of the sulfur originally contained in the material is present as a soluble salt in the aqueous phase.

3. A process as set forth in claim 2, wherein the mineral acids of steps (c) and (h) are selected from the group consisting of nitric acid, sulfuric acid, hydrochloric acid, phosphoric acid and mixtures thereof.

4. A process as set forth in claim 3, wherein said mineral acid is an aqueous solution wherein the concentration of said acid ranges between 0.02 to 36N.

5. A process as set forth in claim 2, wherein the basic material of step (f) is selected from the group consisting of oxides, hydroxides, carbonates, and bi-carbonates of alkaline metals, earth-alkaline metals and ammonium and mixtures thereof.

6. A process as set forth in claim 5 wherein said basic material is an aqueous solution, wherein the concentration of said base ranges between 0.02 to 14N.

7. The process as set forth in claim 2, further comprising separately recovering Fe, Co, Ni and V from said first and second precipitates.

8. A process for reducing the porphyrin, sulfur and/or metal content of crude oil before refining, without modifying substantially the chemical structure and physico-chemical properties of other organic compounds present in the crude oil, comprising the steps of:

(a) mixing the crude oil with an alkaline solution to produce a suspension;

(b) bubbling chlorine gas into the suspension produced in step (a) to the saturation point;

(c) adding a mineral acid to the saturated suspension produced in step (b);

(d) adding a light organic solvent to the resulting mixture from step (c);

(e) stirring the mixture from step (d) at a temperature ranging from about 20° to 70° C.; and then (f) separating an aqueous phase of the stirred mixture from an oil phase of the stirred mixture, said oil phase comprising crude oil of reduced porphyrin, sulfur and/or metal content.

9. The process according to claim 8, wherein the light organic solvent is selected from the group consisting of kerosene, gasoline, xylol, toluene, chloroform, carbon tetrachloride and tetrahydrofuran.

10. A process as set forth in claim 8, further comprising the steps of:

(g) adjusting the pH of the aqueous phase of step (f) to pH 7 or higher by adding a basic material, thereby forming a first precipitate in the aqueous phase;

(h) separating said first precipitate from the aqueous phase, said first precipitate containing substantially all of the iron, nickel and cobalt originally present in said material;

(i) adjusting the pH of the aqueous solution from steps (g) and (h) to pH 6 or less by adding a mineral acid thereby forming a second precipitate in the aqueous phase; and (j) separating the second precipitate formed at step (i) from the aqueous phase, said second precipitate consisting essentially of vanadium pentoxide whereby substantially all of the vanadium originally contained in the material is recovered, and whereby substantially all of the sulfur originally contained in the material is present as a soluble salt in the aqueous phase.

11. A process as set forth in claim 2, further comprising the step of recovering gases evolved during steps (b), (c) and (d) in a basic material capable of absorbing or reacting with said gases.

12. A process as set forth in claim 11, wherein the basic material is selected from the group consisting of oxides, hydroxides, carbonates and bicarbonates of alkaline metals, alkaline earth metals and ammonium, and mixtures thereof.

* * * * *